United States Patent [19]

Klein et al.

[11] 4,165,809

[45] Aug. 28, 1979

[54] PROCESS FOR DELIVERING CYLINDRICAL CONTAINERS TO MACHINES FOR FURTHER PROCESSING

[75] Inventors: Hans J. Klein, Wuppertal; Fritz Henze, Leverkusen, both of Fed. Rep. of Germany; Bernhard Vinzelberg, deceased, late of Leverkusen, Fed. Rep. of Germany, by Selma Margot Vinzelberg, heir; Peter Vinzelberg, heir, Leverkusen; Susanne Klein nee Vinzelberg, heir, Remscheid, both of Fed. Rep. of Germany

[73] Assignee: Bayer Aktiengesellschaft, Leverkusen, Fed. Rep. of Germany

[21] Appl. No.: 809,359

[22] Filed: Jun. 23, 1977

[30] Foreign Application Priority Data

Jul. 3, 1976 [DE] Fed. Rep. of Germany ..... 2630069

[51] Int. Cl.[2] ..... B65G 47/06

[52] U.S. Cl. ..... 414/104; 198/470; 198/533; 221/202; 414/131

[58] Field of Search ..... 214/1 R, 8.5 A, 8.5 F, 214/8.5 K, 152; 198/470, 533, 540, 562; 221/183, 184, 202

[56] References Cited

U.S. PATENT DOCUMENTS

| | | | |
|---|---|---|---|
| 789,086 | 5/1905 | Diebel | 221/202 X |
| 1,676,109 | 7/1928 | Oldenbusch | 221/202 |
| 3,187,940 | 6/1965 | Harris | 198/540 X |
| 3,410,452 | 11/1968 | Igel et al. | 221/183 X |
| 3,869,046 | 3/1975 | Gerhart | 214/1 R |

*Primary Examiner*—L. J. Paperner

*Attorney, Agent, or Firm*—Sprung, Felfe, Horn, Lynch & Kramer

[57] ABSTRACT

In a process for delivering cylindrical containers into machines for further processing, the containers slide into a feed channel under gravity in a random sequence and are transported through this channel in an upright position by the action of an intermittently operating thrust. From the feed channel, the containers are transferred in sequence to a transport carriage equipped with individual holders which are successively positioned in relation to the feed channel. When fully loaded, the transport carriage is driven into the machine for further processing.

13 Claims, 9 Drawing Figures

PROCESS FOR DELIVERING CYLINDRICAL CONTAINERS TO MACHINES FOR FURTHER PROCESSING

Figure 1:
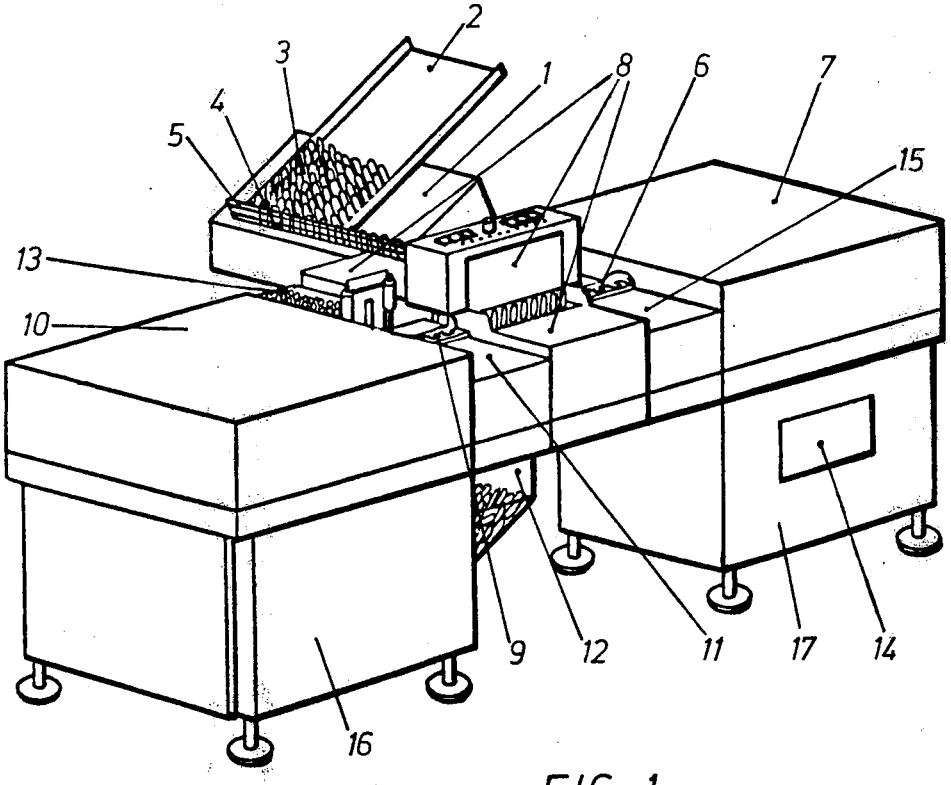

This invention relates to a process for delivering objects having a circular cross-section, in particular pharmaceutical ampoules, to machines for further processing. The invention also relates to an apparatus for carrying out this process.

The problem frequently arises of transferring fragile cylindrical containers such as bottles, jars, ampoules or the like from a storage place where they are kept in a disorderly state to a machine for further processing. By "machines for further processing" are meant, for example, packaging machines, automatic sealing machines and control instruments used to test for the presence of foreign bodies such as fluff, glass splinters, dirt or deposits in the liquid, in the container. The reliability of the machines is to a large extent determined by the method employed for delivering the containers to them. If the containers are broken on their way to the machines, the machines are liable to get blocked or damaged.

With the known processes and apparatus for transporting containers into such machines, the machines are operated at a fixed frequency which determines the speed of the process (see, for example, German Auslegeschrift No. 1,573 413). The use of a fixed machine frequency has certain disadvantages. Apart from the fact that conversion to a different, and particularly to a higher speed of transport is often impossible or at least very laborious and time-consuming, the rigidity of the system, which is due to the fixed machine frequency, often causes damage to fragile containers of the kind which are particularly liable to suffer in transport due to the nature of their surface, (e.g., if the surface is soiled or carries printed matter). The cleaning up processes then necessary may cause prolonged periods of standstill of the machine and hence considerable time losses. It is therefore an object of the present invention to provide a process in which objects having a circular cross-section can be transferred quickly and safely, i.e., substantially without breakage, from a store to a machine for further processing.

According to the invention, there is provided a process for delivering objects having a circular cross-section to machines for further processing (as herein defined) wherein the objections are caused to slide into a feed channel under gravity in a random sequence and are transported through the feed channel in an upright position under the action of an intermittent thrust, a transport carriage having individual holders for the objects is moved stepwise in front of the end of the feed channel and is successively charged with objects from the feed channel, transfer of an object into an individual holder is not attempted until this holder has been positioned correctly in relation to the feed channel, when transfer of the object has been effected, the following holder is positioned in relation to the feed channel by onward movement of the transport carriage, and the transport carriage loaded with objects is then driven into the machine for further processing.

An apparatus suitable for carrying out this process comprises a shaft inclined to the horizontal down which the objects slide into a feed channel under gravity, a sliding device arranged at one end of the feed channel to transport the containers through the feed channel by means of an intermittent thrust, a transport carriage having individual holders for the objects, which carriage transfers a set of containers to a machine for further processing (as herein defined), a recoiling locking pawl arranged at the outlet end of the feed channel, wherein the transport carriage is in the form of a rake having individual holders for the objects arranged in a straight line, said carriage being displaceable parallel to said straight line, and a control circuit to coordinate the movements of the sliding device and of the transport carriage by means of a signal released by the locking pawl during its closing movement so that the end of the feed channel does not attempt to transfer an object to an individual holder until the said holder has been positioned correctly in relation to the feed channel and when transfer has been effected, the following holder is positioned in relation to the feed channel by onward movement of the transport carriage.

The individual holders on the transport rake are preferably equipped with clamping springs for retaining the objects.

The sliding device is advantageously provided with an automatic repeating mechanism which returns the sliding device and reactuates it if an object has not been pushed into an individual holder within a predetermined time.

According to a preferred embodiment of the invention, the sliding device is driven by a slip clutch which comes into operation when the force exerted in the feed channel for pushing in the container exceeds a predetermined value.

According to a further development of this invention, the sliding device is equipped with a cam which during the return movement to the starting position loosens up the pile of containers in the storage shaft.

The advantages of the invention lie in the fact that the individual objects, i.e., containers, can be transported under safe conditions and are gently pushed into the individual holders and that the sequence of the transport of the containers is coupled with the transfer of containers into the transport carriage. The containers can therefore be rapidly and safely transported to the machine for further processing, regardless of the condition of the containers itself and in particular their friction properties or susceptibility to damage (thin walls, cracks). This signifies an important improvement compared with the processes hitherto employed since the properties mentioned above fluctuate widely and can be affected by factors such as dirt or the application of printed matter on the containers. Due to the automatic repeating mechanism of the sliding device, the containers will not be broken if they get jammed in the feed channel but will automatically be freed by return of the sliding device to its starting position. In this connection, the loosening up of the containers in the storage shaft by the return movement of the sliding device plays an important role.

The invention will now be described in more detail with reference to an example illustrated in FIGS. 1 to 7. The example selected here is the transfer of pharmaceutical glass ampoules from a storage shaft to an automatic ampoule tester. The example is illustrated schematically in the drawings.

Figure 2A:
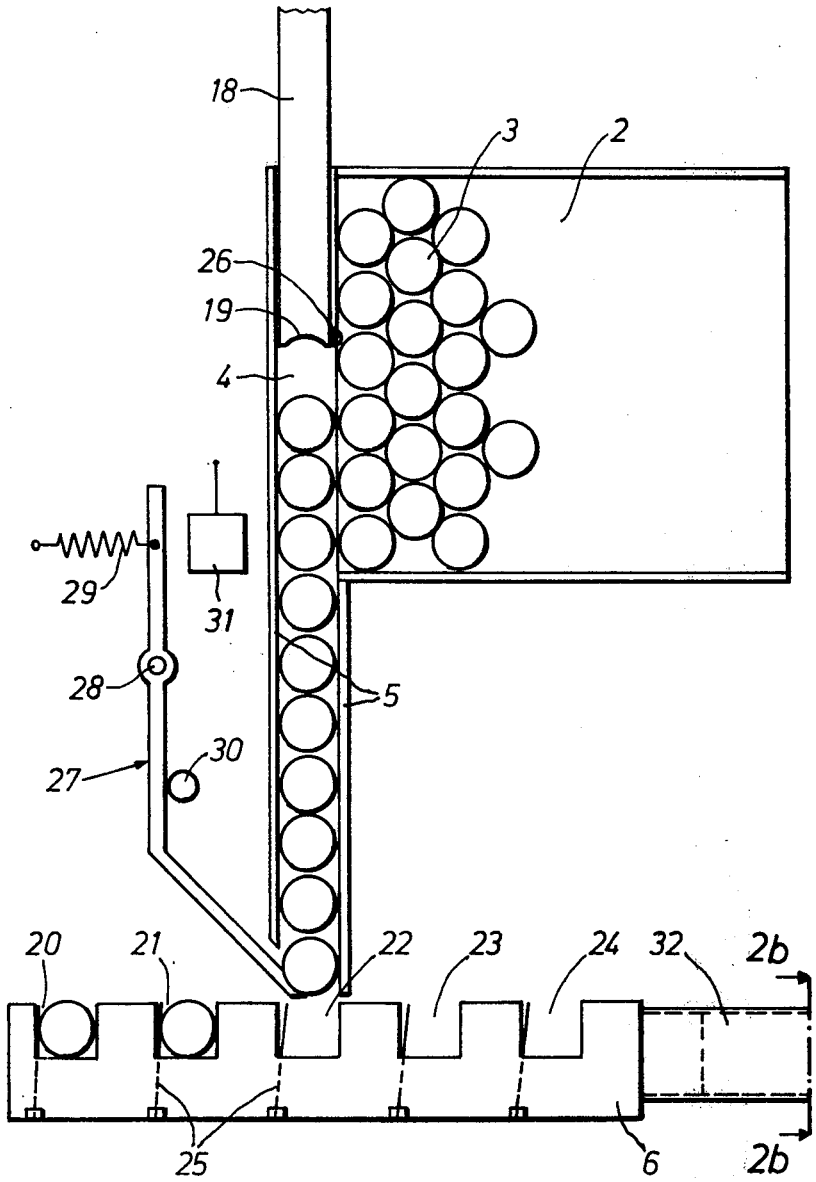
Figure 2B:
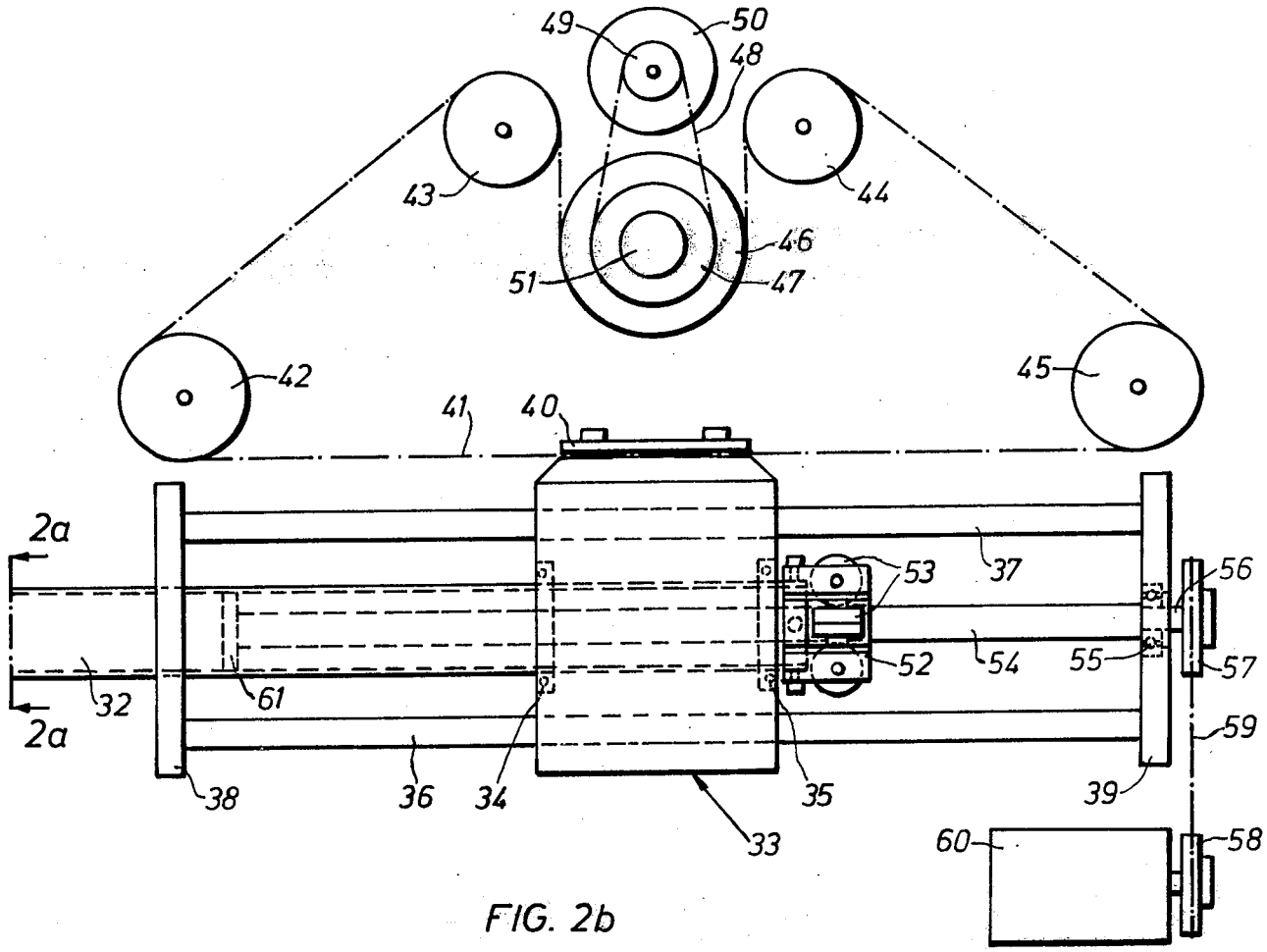
Figure 3:
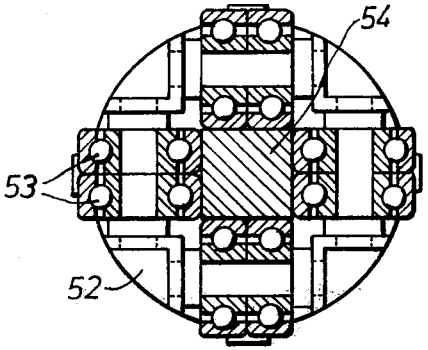
Figure 4:
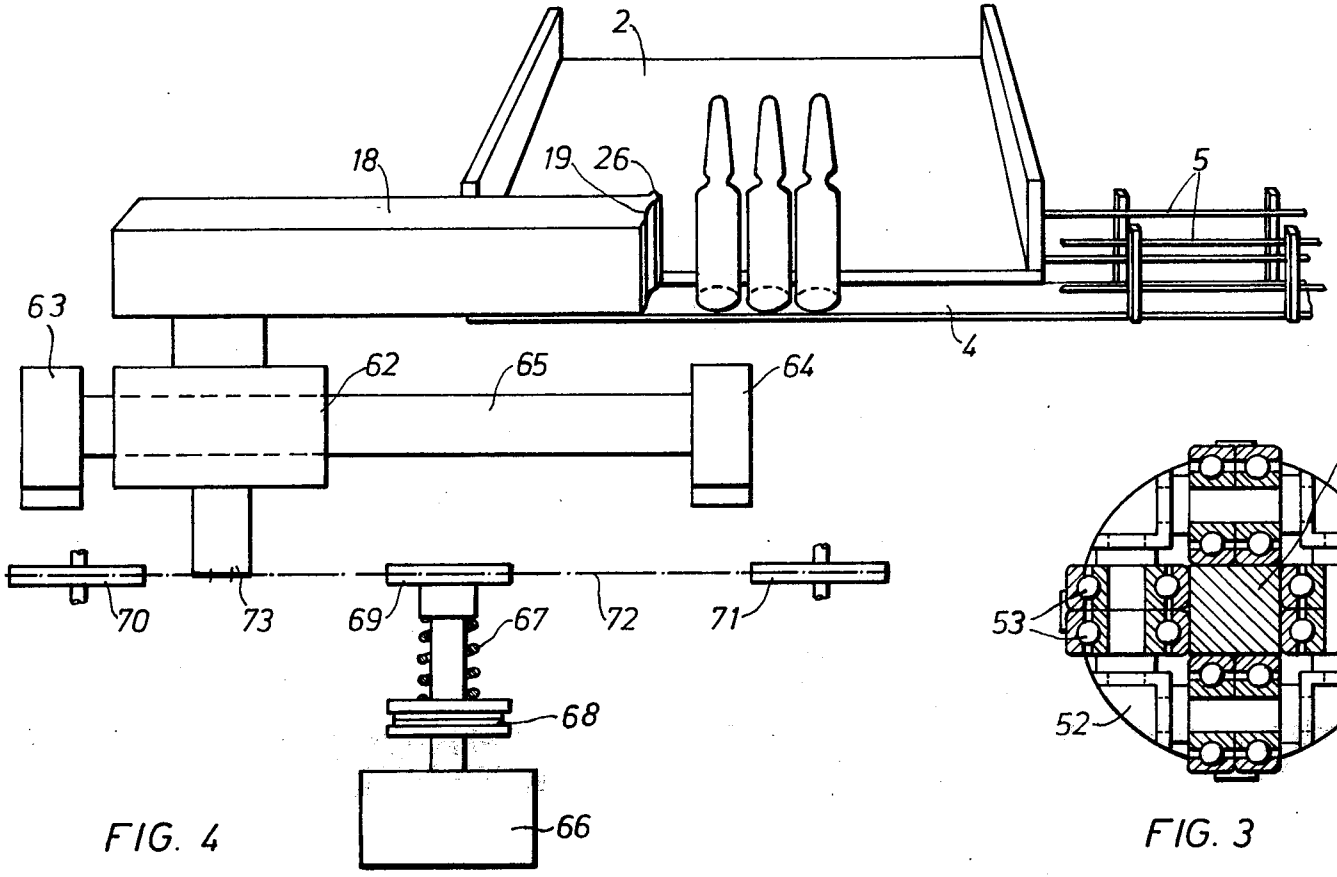
Figure 5:
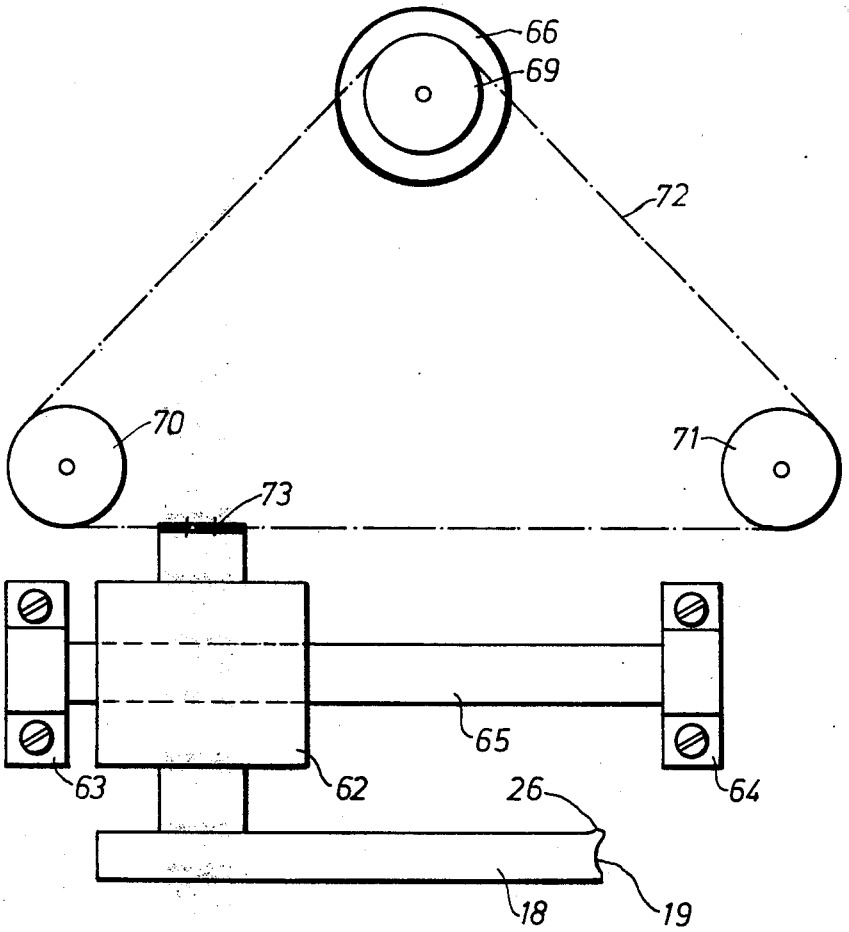
Figure 6:
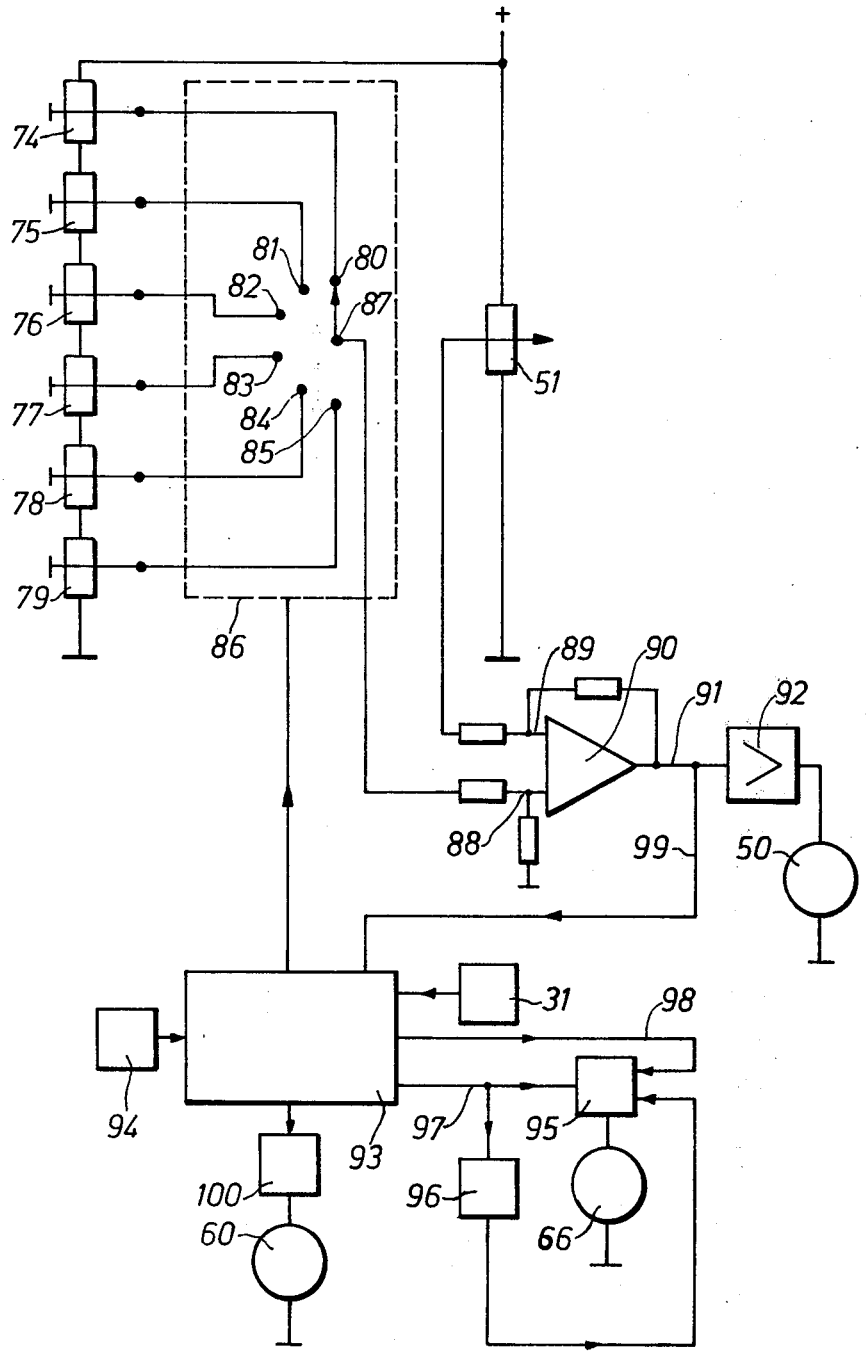
Figure 7A:
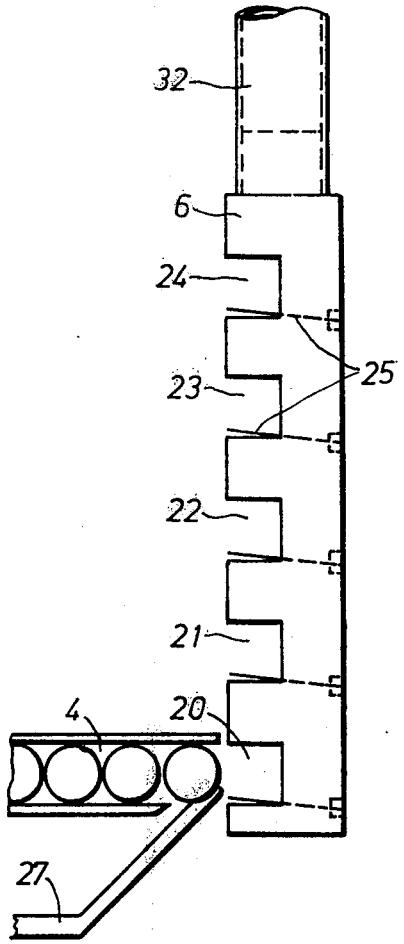
Figure 7B:
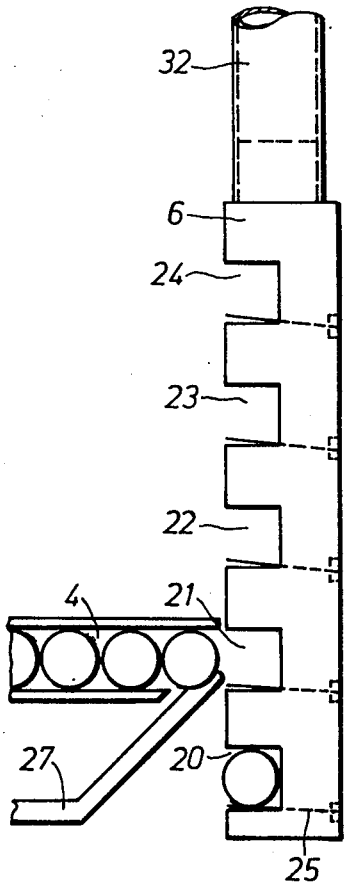

FIG. 1 is a front view in perspective of the automatic ampoule tester in its casing, FIGS. 2*a* and 2*b* are two halves of a top plan view of the ampoule delivery device, the ampoule transport device and the device for deflecting the ampoule transport arm, FIG. 3 is a cross-section through the ball bearing arrangement for the deflecting movement of the ampoule transport arm, FIG. 4 is a side view of the ampoule delivery device, FIG. 5 is a top plan view of the driving mechanism of the ampoule delivery device shown in FIG. 4, FIG. 6 is a block diagram of the control means for controlling the driving mechanism of the ampoule delivery device, the ampoule transport device and the deflecting device for deflecting the ampoule transport arm, and FIGS. 7*a* and 7*b* show the starting position and the following position respectively of the ampoule transport arm in relation to the ampoule delivery channel during delivery of the ampoules.

FIG. 1 is a schematic view in perspective of the automatic ampoule tester in its casing. The ampoule delivery device 1 consists of a feed shaft 2 on which the ampoules are easily slidably inclined to the horizontal at an angle of about 30°, in which the ampoules 3 slide into a feed channel 4 (see FIGS. 2 and 3) adjacent to the lower part of the shaft. This channel 4 is adapted to the diameter of the ampoules. The feed channel 4 is bounded laterally by elements 5 such as support bars or the like which allow for easy cleaning of the channel. The ampoules are pushed from the feed channel 4 into a transport carriage 6 which has the shape of a rake. When the carriage 6 has been completely filled with ampoules, it transports them to a control station 8 by means of a drive situated under the covering hood 7 (see FIG. 2) and deposits them there. The method of delivering and transporting the ampoules is further illustrated in FIGS. 2 to 7. In the control station 8, light is passed through all the ampoules together but the liquid content of each individual ampoule is projected separately on a suitable photoelectric receiver by means of a lens system. In this station 8, the ampoules are rapidly rotated and suddenly stopped so that the liquid in the ampoules and any foreign particles in it continue to rotate so as to release electric impulses in the photoelectric receivers which are switched into the circuit at the correct interval after the ampoules have been brought to a halt. Any ampoules recognised by this process as defective are then sorted out according to their locations and stored away. A high output rate is achieved by simultaneously testing several ampoules in one test cycle. 10 Ampoules in a test cycle of 4 seconds, for example, provide an output of 9000 ampoules per hour. A second transport rake 9 driven by a driving mechanism under the cover hood 10 similar to the driving mechanism of the transport rake 6 fetches the ampoules which have been checked from the control station 8 and brings them to the ampoule discharge station 11, where the ampoules are pushed out of the transport rake 9 and those which have previously been recognised as defective and stored away are dropped into the receiver 12 while the good ampoules are counted into packaging units and sorted into the sales package 13. The result of the ampoule control operation may be put out, for example, on a printer 14. Control devices for the signal amplifiers and lamp intensity, adjustment means for the sensitivity of measurement and speed of control and counters for registering the ampoules separated according to the total number and the number of good and bad ampoules are situated below the cover 15. The electronic devices for processing the signals and controlling the instrument are situated in the lower compartments 16 and 17.

The ampoule delivery device, ampoule transport device and deflecting device for the transport rake 6 are described in more detail below. A top plan view of the devices is shown in FIG. 2. The ampoules 3 slide from the feed shaft 2 into the feed channel 4 which is situated below the level of the bottom of the feed shaft 2 (see FIG. 4), so that the ampoules are carried to the side of the feed shaft 2. The boundary to the feed channel 4 is otherwise formed by the guide bars 5. The sliding or pushing device 18 which ends in a concave curvature 19 adapted to the radius of the ampoules, pushes the ampoules along the feed channel 4 and into successive recesses 20, 21, 22, 23 and 24 in the transport rake 6. To secure the ampoules in transport, they are clamped in these recesses by clamping springs 25 inserted therein. The number of recesses in the transport rake 6 provided in this example, which is five, is arbitrary, and a larger number could, of course, be provided if higher output rates are required. The sliding device 18 has a cam or cog 26 at its front end which loosens the collection of ampoules 3 as the sliding device returns to its starting position to overcome any jamming which would prevent the ampoules from sliding into the feed channel 4.

The ampoule situated at the exit from the feed channel 4 is held by a locking pawl 27 which is pivoted at 28 and pressed against the abutment 30 by the tension spring 29, the said abutment 30 also serving to adjust the position. 31 is a feeler, for example an inductive proximity feeler, which produces an electric signal at its output end as soon as an ampoule has been pushed into one of the recesses 20 to 24 of the transport rake 6 so that the pawl 27 has been returned to its original inoperative position.

As shown in FIG. 2*b*, a guide tube 32 is attached to the transport rake 6. This tube 32 is fixed to the lateral ball guide 33 at its other end but can be rotated about its axis in the ball bearings 34 and 35. The ball guide 33 is guided on guide rods 36 and 37 which are fixed to supports 38 and 39. The ball guide 33 is connected by the strap 40 to the drive belt 41, preferably a sprocket belt. The drive belt 41 moves over the deflecting rollers 42, 43, 44 and 45 and over the sprocket wheel 46. A second sprocket wheel 47 is mounted on the shaft of the sprocket wheel 46. The wheel 47 is connected to the driving sprocket wheel 49 by the drive belt 38, which is also preferably a sprocket belt. The system is driven by the motor 50 (see FIG. 6). A disc wheel motor is preferably used because such a motor can be accurately controlled and therefore provides the possibility of exact positioning of the transport rake 6, although other motors could, of course, also be used, for example stepping motors. A precision potentiometer 51 is mounted on the shaft of the sprocket wheels 46 and 47 to serve as displacement pick-up. Here again, other, analogous pick-ups or even digital displacement pick-ups could be used. Control of the motor 50 and hence exact positioning of the transport rake 6 is carried out by comparing the voltage across the tapping arm of the potentiometer 51 with nominal values. This method of control will be described in more detail with reference to FIGS. 6 and 7.

When the ampoules in the transport rake 6 have been transported to the control station 8 (FIG. 1), they are required to be deposited there. For this purpose, the ampoules, while still inside the transport rake 6, are first clamped between turntables and counter bearings in the direction of rotation in which they are subsequently to be rotated. They are then loosened from the transport rake 6 by swinging the rake through 90° about its longitudinal axis in a plane perpendicular to the plane of the drawing. This is achieved by means of the apparatus described below (FIG. 2).

A ball bearing arrangement 52 is screwed from outside to the end of the guide tube 32 which is rotatable (but not displaceable) in the ball guide 33. The ball bearing arrangement 52 consists of four double ball bearings 53 arranged at right angles to each other and rolling against the lateral surfaces of a guide rod 54 which is square in cross-section. The ball bearing arrangement 52 is shown in cross-section in FIG. 3. A spindle 56 is attached to the end of the guide rod 54, which guide rod is rotatably mounted in the support 39 by means of the ball bearing 55. The sprocket wheel 57 is mounted on the said spindle 56. The guide rod 54 and hence the rake 6 can be rotated about its longitudinal axis by means of the drive 60 by way of the sprocket wheel 58 and the connecting sprocket belt 59. The drive 60 is preferably a disc wheel motor because such a motor can be easily and accurately controlled, although other driving means could, of course, be used, for example rotary magnets. For the sake of stability, a smoothly sliding, abrasion resistant plastics disc 61 designed to fit the internal wall of the guide tube 32 is mounted on that end of the guide rod 54 which is inside the guide tube 32, so that the guide tube 32 slides along it in the movement of translation.

The effect of the arrangement described above is that the movement of translation starting from the drive 50 and the deflecting movement of the transport rake 6 starting from the drive 60 can be carried out independently of each other. As mentioned earlier, the deflecting movement is necessary for depositing the ampoules in the control station or fetching them from the control station.

The ampoule delivery device 1 (FIG. 1) is shown in more detail in FIGS. 4 and 5. FIG. 4 is a side view of the delivery device, FIG. 5 a top plan view of the mechanism for driving the sliding or pushing mechanism 18. The two figures will be considered side by side for a better understanding of the apparatus. For the sake of clarity, the boundary 5 of the feed channel 4 has only been shown partially in FIG. 4 and only three ampoules are shown in the feed channel 4. The sliding mechanism 18 is connected to the ball bearing device 62 which is adapted to slide backwards and forwards on the guide rod 65 which is fixed to the supports 63 and 64. The sliding device 18 is driven by the motor 66, hereinafter referred to as the sliding motor, which is connected to the driving sprocket wheel 69 by way of the slipper clutch 68 which is pressed into engagement by the spring 67 which has an adjustable contact pressure. The driving sprocket belt 72 is carried over the driving sprocket wheel 69 and the two deflecting rollers 70 and 71 and is connected to the ball bearing 62 by the strap 73. The driving motor 66 used in this case is also preferably a disc wheel motor on account of its good control characteristics. The contact pressure on the clutch 68 is adjusted so that on the one hand ampoules can easily be delivered while on the other hand, if ampoules get jammed in the feed channel 4, the clutch can quickly be released so that no ampoules get broken.

The procedure of ampoule delivery, ampoule transport and deflection of the transport rake will now be described with reference to FIGS. 6 and 7. A positive voltage is applied to the potentiometers 74, 75, 76, 77, 78 and 79 which are connected in series, and this voltage is also supplied to the positioning potentiometer 51 (FIG. 2). The tapping points of the potentiometers 74 to 79, which are set at fixed positions corresponding to exact positionings of the transport rake 6 (FIGS. 2 and 7), are transmitted to the step-by-step switching mechanism 86 according to the switching positions 80, 81, 82, 83, 84 and 85, that is to say the tapping point of potentiometer 74 is transmitted to position 80, the tapping point of potentiometer 75 to 81, and so forth. The output 87 of the step-by-step switching mechanism 86, which may be electromechanical or electronic in known manner, is transmitted to one input 88 of the difference amplifier 90 while the tapping point of the positioning potentiometer 51 is fed to the other input 89 of said amplifier 90. This means that the actual positioning of the rake 6 (FIG. 2) is constantly compared with the required position given by the switching position of the stepping mechanism 86. The output 91 of the difference amplifier 90 is connected both to the output amplifier 92 to operate the transport motor 50 for the rake 6 (FIG. 2) and to a control circuit 93 of known design. Also connected to the control circuit 93 are: the step-by-step switching mechanism 86, a starting circuit 94, the inductive capacitance feeler 31 which is operated by the pawl 27 (FIG. 2), the device 95 for driving the sliding motor 66 (FIGS. 4 and 5) and a time switch 96 which is also connected to the motor control circuit 95. The signal for forward movement of the slide 18 (FIG. 2), i.e., for pushing an ampoule forward, is transmitted through the control lead 97 while the signal for the return movement of the slide 18, which causes the ampoules to slide from the feed shaft 2 (FIG. 2) into the feed channel 4, is transmitted through the control lead 98. The position of the rake 6 (resting position control) is indicated to the control circuit 93 through the signal lead 99.

At the start of the ampoule delivery, the rake 6 is in its resting position in which the feed channel 4 is exactly opposite the first recess 20 of the rake 6 (FIG. 7*a*). This corresponds to the switching position illustrated in the step-by-step switching mechanism 86, in which point 87 is connected to point 80. The voltages transmitted to the difference amplifier 90 at the inputs 88 and 89 are equal so that the output 91 of the difference amplifier 90 is at zero potential. When the starting circuit 94 is put into operation, the sliding motor 66 (FIGS. 4 and 5) is driven forwards by the control circuit 93, the signal lead 97 and the motor control 95, and the first ampoule is pushed into the recess 20 of the rake 6. As soon as the ampoule has been pushed into the recess 20 of the rake 6, so that the pawl 27 is again in its resting position, a signal is released in the feeler 31, indicating to the control circuit 93 that the operation of pushing the ampoule into position has been completed. This signal causes the stepping mechanism 86 to be switched forwards by one position so that the point 87 is now connected to point 81. The voltage at the input 88 of the difference amplifier 90 becomes smaller so that the output 91 of the difference amplifier 90 is no longer zero, for example it may be positive. This causes the transport motor 50 to be actuated by the output operation amplifier 92 so that the rake 6 is moved in the direction of the next position. The voltage at the tapping point of the positioning potentiometer 51 which is coupled to the drive also becomes smaller, so that the voltage at the output 91 of the difference amplifier 90 again approaches zero. When the output 91 is at zero, the second position of the rake 6 is reached, so that the drive motor 50 is again in its inoperative position. This is illustrated in FIG. 7*b*. The recess 21 is now situated exactly opposite the feed channel 4. Immediately after reaching the new position, i.e., zero at the output 91 of the difference amplifier 90, the control circuit 93 again transmits a signal to the motor control 95 to push the second ampoule into the recess 21. The process of sliding an ampoule into position and transporting it while switching the step-by-step switching mechanism 86 forwards now begins from the beginning and is repeated until ampoules have been pushed into all the recesses 20 to 24 of the rake 6. When the fifth ampoule has been pushed into the recess 24, the stepping mechanism 86 switches from position 84 to position 85 which corresponds to the positioning of the rake 6 in the control station 8 (FIG. 1). The transport rake is now set in motion as described above by way of the circuits 90, 92 and the motor 50, and travels into the control station 8. On reaching the position (output 91 of the difference amplifier 90 at zero), the command for return of the slide 18 (FIGS. 2, 4 and 5) to its starting position is given to the slide motor 66 by way of the control circuit 93, the signal lead 98 and the motor control 95, and at the same time the command for deflection is transmitted to the deflection motor 60 (FIG. 2) by way of the motor control 100. The ampoules are deposited by upward deflection of the rake 6 through 90° about its longitudinal axis. The stepping mechanism 86 is then actuated by the control circuit 93 and brought to the switching position 80, which corresponds to positioning of the rake in the starting position. The voltage at the input 88 of the difference amplifier 90 is now greater than that at the input 89, so that the output 91 is negative. The motor 50 is then driven with reversed polarity so that the transport rate travels backwards until it reaches its starting position (FIG. 7*a*). When this position is reached, the process of sliding the ampoules into position and transporting them resumes automatically, that is to say without renewed actuation of the starting circuit at 94 (this is only necessary the first time).

With each sliding of an ampoule into one of the recesses 20 to 24 of the transport rake 6, the time switch 96, for example a monostable time element with fixed time setting, is switched on at the beginning of this process in order to check, by means of the control circuit 93, whether this operation of sliding the ampoule into position, takes place within the given time, that is to say whether completed insertion of an ampoule into its recess is announced back to the proximity feeler 31 by way of control circuit 93 within the given time. If this is the case, sliding of the ampoules into position and transport continue unhindered. If, however, for some reason the signal is not given within the required time, the sliding motor 66 is switched to reverse by way of the motor control 95 after expiry of the time fixed in the circuit 96 so that the slide 18 is moved back to its starting position, from which it is then automatically moved forwards again. This forward and backward movement is repeated until an ampoule is finally inserted and the operation proceeds normally.

This automatic sliding control is extremely important for trouble-free delivery of the ampoules. If, for example, the ampoules get jammed in the feed channel 4 (FIG. 2) during this delivery, the slip clutch 68 (FIG. 4) comes into operation within the time fixed by the time switch 96, thereby preventing breakage of the ampoules if correctly adjusted. After expiry of the given time, the slide travels back and again moves forwards. Experience has shown that a few repetitions of these movements are in most cases sufficient to release any jamming and enable delivery to proceed normally.

The automatic sliding control described above has also proved to be effective in cases where, for example, sliding of the ampoules from the feed shaft 2 into the feed channel 4 (FIG. 2) is prevented by jamming of ampoules closest to the feed channel 4 so that there are no ampoules in the channel 4 to be pushed into the rake. The repeated forward and return travel of the slide then continues until the cog 26 of the slide 18 (FIG. 2) releases the jamming in its return movement and the ampoules again slide into the feed channel 4.

Summarizing, the apparatus described above provides for safe, i.e., trouble-free and rapid delivery of ampoules from a store and their transport. This is achieved by arranging the delivery and transport of the ampoules to take place not according to a fixed, predetermined frequency but sequentially upon the preceding ampoule. The process of ampoule delivery and transport becomes independent of the nature (e.g. size) of the ampoule and of its external state (e.g. printed matter, dirt, cracks) which affect its sliding properties and ease of transport.

By using rapidly actuated disc wheel motors, high delivery and transport velocities can be obtained, which lead to higher outputs of the ampoule tester. In the automatic ampoule tester described in the example, outputs of 10,000 ampoules per hour are reached when 10 ampoules are tested simultaneously.

What we claim is:

1. An apparatus for delivering objects, having a circular cross section, in an upright position to machines for further processing comprising: a horizontal feed channel; a horizontally downwardly inclined feed shaft on which the objects slide randomly in an upright position into the feed channel under the force of gravity; sliding means disposed at one end of the feed channel for imparting an intermittent thrust to the objects in the feed channel to transport the objects side by side and in an upright position through the feed channel; transport carriage means having individual holders for the objects to hold them in an upright position for transferring a set of objects from the feed channel to a station for further processing, the transport carriage means comprising a rake having individual holder slots arranged in a straight line, each configured to hold one object and means for displacing the rake parallel to said straight line; means for sensing the transfer of each object from the feed channel to the rake and for generating a sensing signal when each individual one of the objects is transferred; and control means receptive of the sensing signal for asynchronously coordinating the movements of the sliding means and of the transport carriage means to effect displacement of the rake after the transfer of one object and to disable actuation of the sliding means until the rake has been positioned correctly in relation to the feed channel such that an empty holder slot is aligned with the outlet of the feed channel.

2. An apparatus as claimed in claim 1, wherein the sensing means comprises a recoiling locking pawl and a switch coactive therewith for producing the sensing signal when an object passes the outlet end of the feed channel and actuates the locking pawl.

3. An apparatus as claimed in claim 1, wherein the individual holders have clamping springs for retaining the objects.

4. An apparatus as claimed in claim 1, wherein the sliding means comprises means for returning same and reactuating same when an object has not been pushed into the individual holder within a predetermined time.

5. An apparatus as claimed in claim 1, wherein the sliding means comprises an adjustable slip clutch for driving same and which comes into operation when the force expended to push the container in the feed channel exceeds a predetermined value.

6. An apparatus as claimed in claim 1, wherein the sliding means comprises a cog which loosens the containers in the storage shaft during its return movement into its starting position.

7. An apparatus as claimed in claim 1, wherein the rake is adapted to be deflected about an axis parallel to the direction of transport.

8. An apparatus as claimed in claim 4, further comprising means for driving the rake for the movement of translation and an electric displacement pick-up coupled therewith and whose output voltage is compared with given nominal values for the exact positioning of the rake.

9. An apparatus as claimed in claim 1, further comprising a guide tube connected at one end to the rake and mounted at its other end in a bearing so as to be rotatable about its longitudinal axis but not displaceable in the axial direction, and a displacement guide for effecting the bearing to be displaceable in the longitudinal direction for movements of translation.

10. An apparatus as claimed in claim 9, further comprising a ball bearing arrangement screwed to the outside of the guide tube and an axial guide rod which is square in cross-section and which is rotatable about its longitudinal axis and wherein the ball bearing arrangement rolls on the four lateral surfaces thereof.

11. An apparatus as claimed in claim 8, wherein the control circuit for operating the sliding means and for operating the rake comprises a step-by-step switching mechanism which, in response to the signal released by the locking pawl in its closing movement, successively dictates the rated voltage values for positioning the transport rake.

12. An apparatus as claimed in claim 11, further comprising a proximity feeler in communication with the locking pawl and which gives off a signal when the locking pawl is closed again after transfer of an object to the rake, effecting the step-by-step switching mechanism to switch forwards by one step so that the next holder is positioned in front of the feed channel, and wherein immediately after this position has been reached, the control circuit sets the sliding means in motion for transfer of the next container.

13. An apparatus as claimed in claim 12, further comprising a time switch in communication with the control circuit and which checks whether the transfer of an object to the rake is reported back by the proximity feeler within a given time and which, in the absence of such a report, sets the automatic repeating device in operation so that the sliding means is returned to its starting position and again put into operation.

* * * * *